United States Patent [19]

Gray

[11] Patent Number: 5,067,850

[45] Date of Patent: Nov. 26, 1991

[54] APPARATUS FOR DETECTION AND CONTAINMENT OF POLLUTANTS IN A DRAINAGE SYSTEM

[75] Inventor: Robert L. Gray, Winchester, Va.

[73] Assignee: Gray Engineering, Inc., Winchester, Va.

[21] Appl. No.: 575,864

[22] Filed: Aug. 31, 1990

[51] Int. Cl.[5] ..... E02B 7/20

[52] U.S. Cl. ..... 405/92; 210/170; 405/52; 405/80

[58] Field of Search ..... 405/36, 37, 39, 80, 405/92, 93, 96, 97, 52; 210/98, 103, 163, 164, 170

[56] References Cited

U.S. PATENT DOCUMENTS

| | | | |
|---|---|---|---|
| 2,796,988 | 6/1957 | Loffler | 210/163 X |
| 3,354,655 | 11/1967 | Armond | 405/96 |
| 3,495,411 | 2/1970 | Clemens | 405/96 X |
| 4,225,434 | 9/1980 | Ernst et al. | 210/98 |
| 4,230,422 | 10/1980 | Brown et al. . | |
| 4,366,846 | 1/1983 | Curati, Jr. . | |
| 4,412,501 | 11/1983 | Davis | 210/103 X |
| 4,478,534 | 10/1984 | McIlwain . | |

FOREIGN PATENT DOCUMENTS

| | | | |
|---|---|---|---|
| 70210 | 4/1985 | Japan | 405/92 |

*Primary Examiner*—David H. Corbin

*Attorney, Agent, or Firm*—Stevens, Davis, Miller & Mosher

[57] ABSTRACT

A storm drainage system including a gate which controls the release of the contents of the drainage system. The gate is motor activated which is responsive to manual activation or hydrocarbon sensor activation. The drainage system includes an overload sensor which detects a filled drainage system, for example by a heavy rain. The sensor provides a high-liquid-level override signal to the motor in response to the filled drainage system to open the gate independently of the hydrocarbon sensor activation.

22 Claims, 10 Drawing Sheets

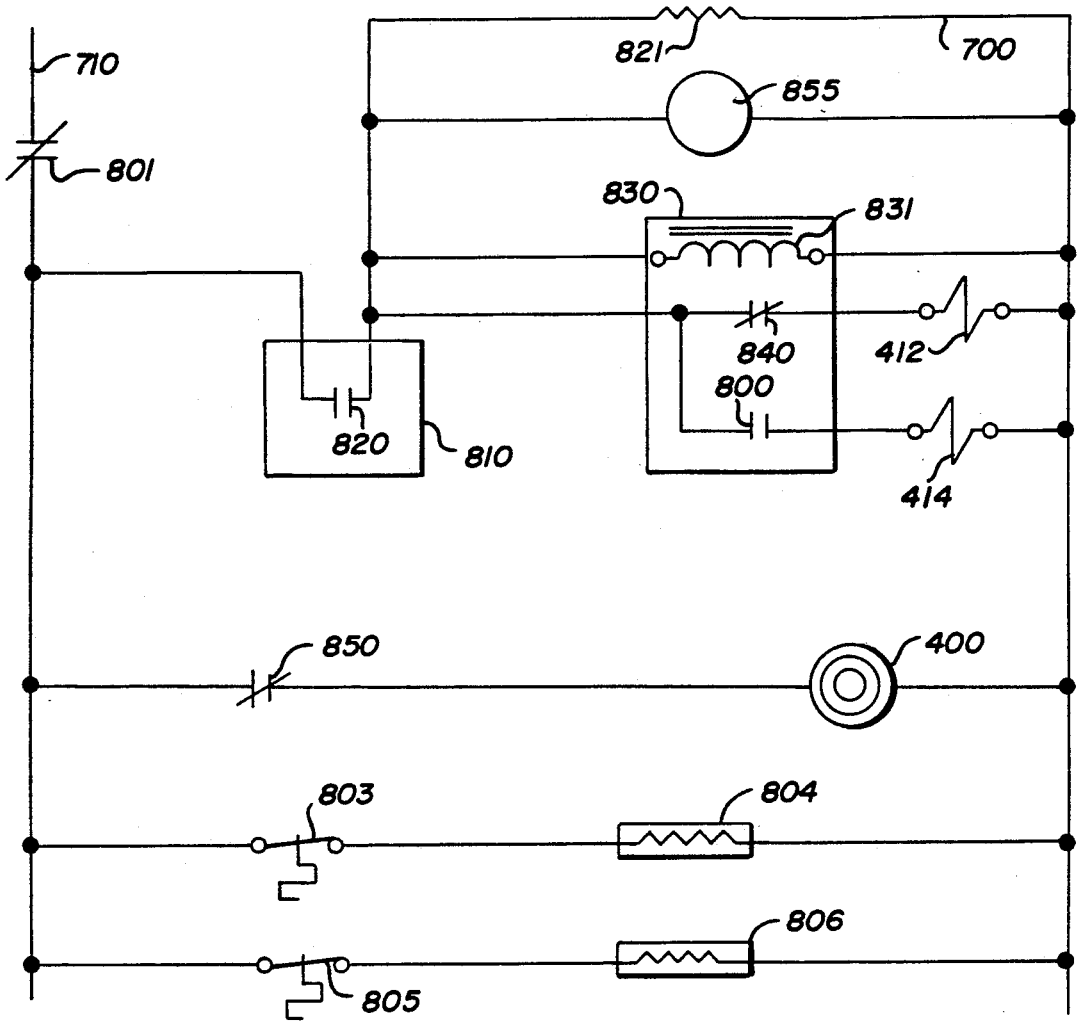
Fig. 14
Fig. 15
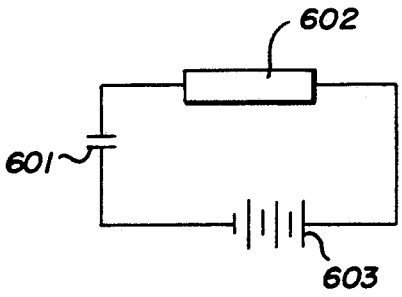
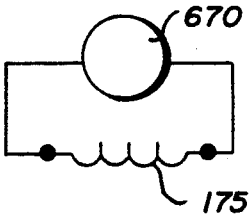
Fig. 20
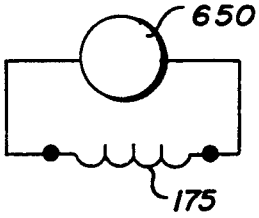
Fig. 19

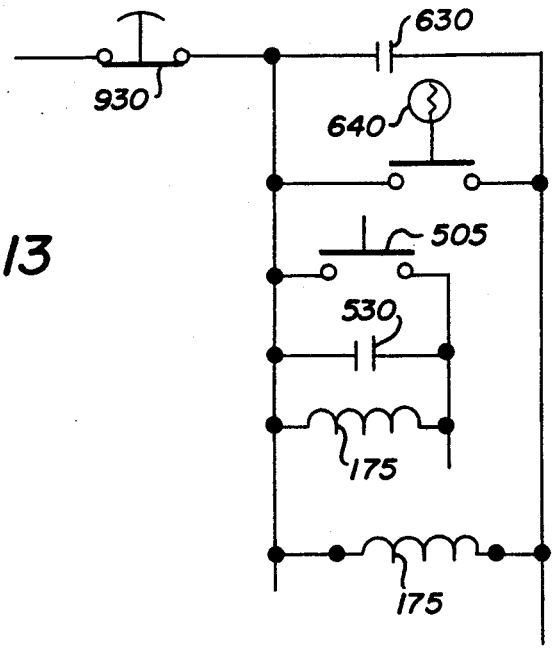
Fig.13
Fig.18
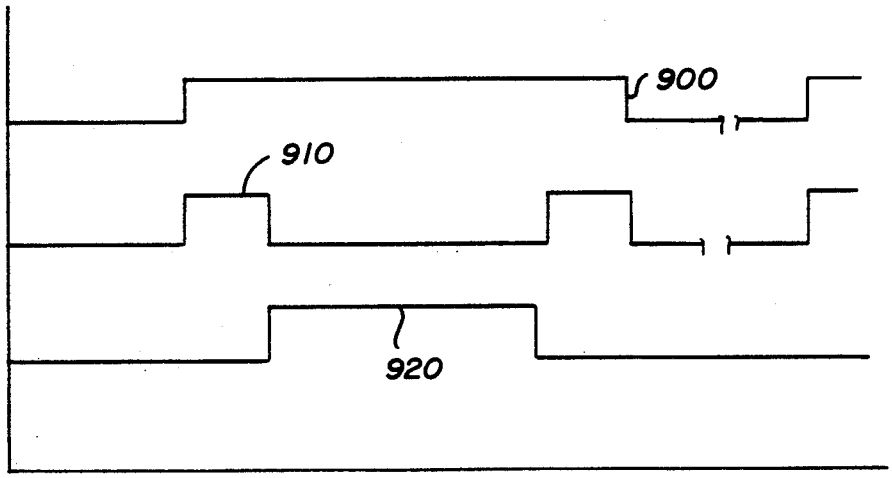
Fig.16
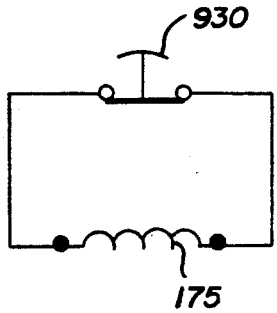
Fig.17
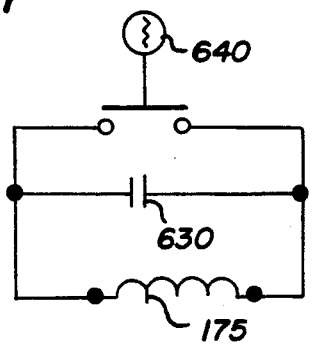

APPARATUS FOR DETECTION AND CONTAINMENT OF POLLUTANTS IN A DRAINAGE SYSTEM

BACKGROUND OF THE INVENTION

1. Field of the Invention

This invention relates to the containment of environmental pollutants which enter a drainage system. Particularly, the system is adapted to contain spills of either hydrocarbons or other chemicals which are present on fuel islands, unloading docks or other bulk containers. These pollutants can damage the environment when released into a drainage system if the pollutants are allowed to reach the unprotected environment.

2. Description of Related Art

Heretofore known types of water and pollutant control systems include, for example, that disclosed in U.S. Pat. No. 4,366,846 to Curati, Jr. which discloses a containment and storage system including a reservoir which transfers petroleum based liquids to a well for collecting and storing liquid along a railroad track system. This well includes a pump which is activated by the rising and falling of the liquids. Another type of system is illustrated by U.S. Pat. No. 4,478,534 to McIlwain which discloses a flood control system for controlling and preventing flooding of areas located in the banks of a waterway. This system includes both water level sensors and gates which are responsive to the water level sensors. However, the prior art has not achieved an automatic or manually-activated system wherein a gate, in response to a sensor or manual intervention, collects hydrocarbons or other pollutants or a system which also includes the capability of detecting an overload of a drainage system to reopen the gate to allow the water, hydrocarbons and other pollutants to flow into the environment without damaging the drainage system or related facilities due to the initial gate closure to contain the pollutants.

SUMMARY OF THE INVENTION

In view of the above-noted deficiencies in the prior art, the present invention provides a storm drainage system comprising at least one conduit means for guiding and containing liquid, a gate disposed on said conduit means, the gate in an open position allowing the liquid to pass by the gate within the conduit means and in a closed position blocking passage of the liquid within the conduit means, and means for remotely activating said gate to occupy said closed mode in response to an operator's detection of the presence of a pollutant within the conduit means.

In another embodiment, the storm drainage system includes at least one conduit means for guiding liquid, a gate disposed on said conduit means, the gate in an open position allowing the liquid to pass by the gate within the conduit means and in a closed position blocking passage of the liquid within the conduit means, a motor means for controlling the gate to alternately occupy the open and closed position, and sensor means positioned to detect the presence of pollutants within said conduit means and to activate the motor to close said gate in response to a detection of the pollutant within said conduit means.

The storm drainage system can further include a liquid level sensing means for detecting the presence of a first predetermined amount of liquid within said storm drainage system and for providing a high-liquid-level override signal to the motor in response to a detection of the first predetermined amount of liquid within the storm drainage system to open said gate independently of the detection of said pollutants within the conduit means by the sensor means. The storm drainage system further includes means for detecting the presence of a second predetermined amount of liquid lower than the first predetermined amount of liquid within the storm drainage system and for providing a signal to the motor means when the second predetermined amount of liquid is detected to enable the gate to occupy the closed position again responsive to a detection of the pollutant within the conduit means.

The remote actuation means can include a manual switch connected to the gate to close the gate manually when an operator detects that a pollution spill has occurred. The motor can be a reversible motor such that the motor can be reversed in a direction to open the gate before the gate is completely closed, and the motor can include a drive stem for connecting the motor with the gate and for raising and lowering the gate. The sensor means can be a hydrocarbon sensor which detects the presence of hydrocarbons, and the sensor can be located in the bottom of a drain pipe.

The system can further include a sensor chamber in which said sensor means is disposed and means for continually filling the sensor box with liquid to prevent the sensor means from providing a false alarm. The sensor box can include a heater to prevent the liquid from freezing and includes a flush means for cleaning the sensor means. The flush means includes a timer means to activate and deactivate the flush means in accordance with a timed flush fill cycle.

The system can further include a brace means for supporting the canal gate to prevent the canal gate from moving in a horizontal direction and a drain pipe connected to the conduit means, with the gate being mounted at a position which is upstream of the end of the pipe. The motor can be mounted on the gate. The system can include a platform which is disposed in the conduit means for mounting the gate.

The system can further include an overload means for detecting an overload condition of the drainage system and for causing the gate to occupy the open position independently of whether the remote actuation means is attempting to cause the gate to be in the closed position. The overload means can include a float to indicate the overload of said drainage system.

As an alternative embodiment, the liquid level sensing means can provide an activation signal to open a valve, e.g., a solenoid valve, for draining out the contents of the storm drainage system in response to a detection of the presence of said first predetermined amount of liquid and to close the valve in response to a detection of said second predetermined amount of liquid. In other words, in the first embodiment, the gate itself is opened when high water conditions are present and then allowed to be reclosed when the water level subsides to a given level, whereas in the second embodiment the valve is opened in response to high water conditions and is otherwise maintained in a closed position.

BRIEF DESCRIPTION OF THE DRAWINGS

The above and other objects, advantages and features of the invention will be more fully understood when considered in conjunction with the following discussion and the attached drawings, of which:

FIG. 13 is a circuit diagram of the motor controls;

FIG. 14 is a circuit diagram of the flush and fill apparatus;

FIG. 15 is a circuit diagram of the telephone dialer circuit;

FIGS. 16 and 17 show additional motor control circuits;

FIG. 18 is a diagram of the timing sequence of the flush and fill operation; and FIGS. 19 and 20 illustrate additional circuit details.

DETAILED DESCRIPTION OF THE PREFERRED EMBODIMENTS

When there has been a spill of liquid fuels, such as hydrocarbon fuels, near dispensing pumps, fuel islands, unloading docks, other bulk fuel containers or other sources of fuels, the danger exists that these fuels could enter a water drainage system, such as one formed of a pipe system which may be connected to a large container such as an underground catchment. In such a system, each pipe generally has a relatively small volume, and the container or catchment has a relatively large volume. In an alternative form, the drainage system can be a series of interconnected pipes which collectively have a large volume, with all of these pipes meeting at a common drain point.

Figure 1:
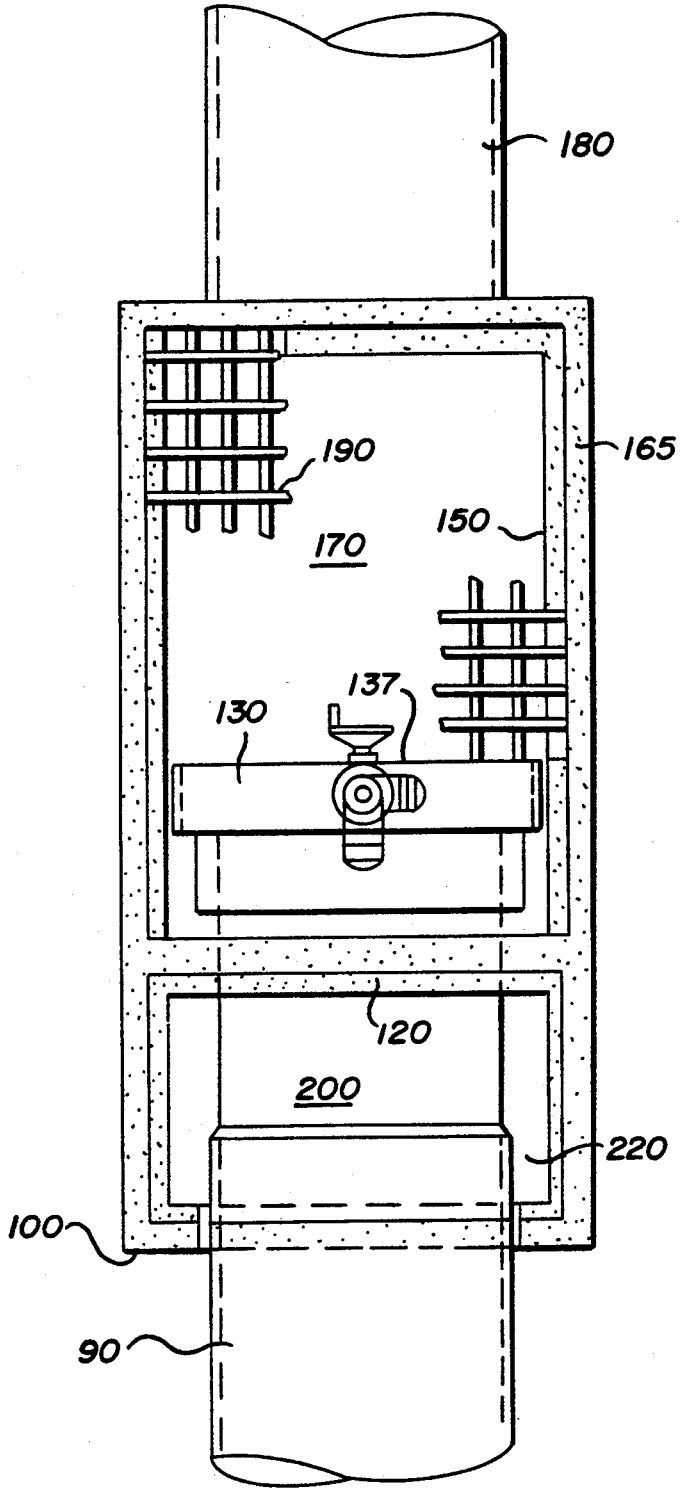
FIG. 1 is a top view of the catchment and canal gate structure.

In these types of systems, as illustrated, for example, in FIG. 1, the spilled fuels or hydrocarbons enter common upstream pipe section 90 which in the preferred embodiment is a 36-inch pipe. The hydrocarbons exit upstream section 90 of pipe and enter catchment 150 which includes canal gate 160. In the preferred embodiment, catchment 150 is 84 inches long. The width of the interior of the catchment is 54 inches. Upstream section 90 of pipe engages catchment 150 at pipe support 100.

Figure 2:
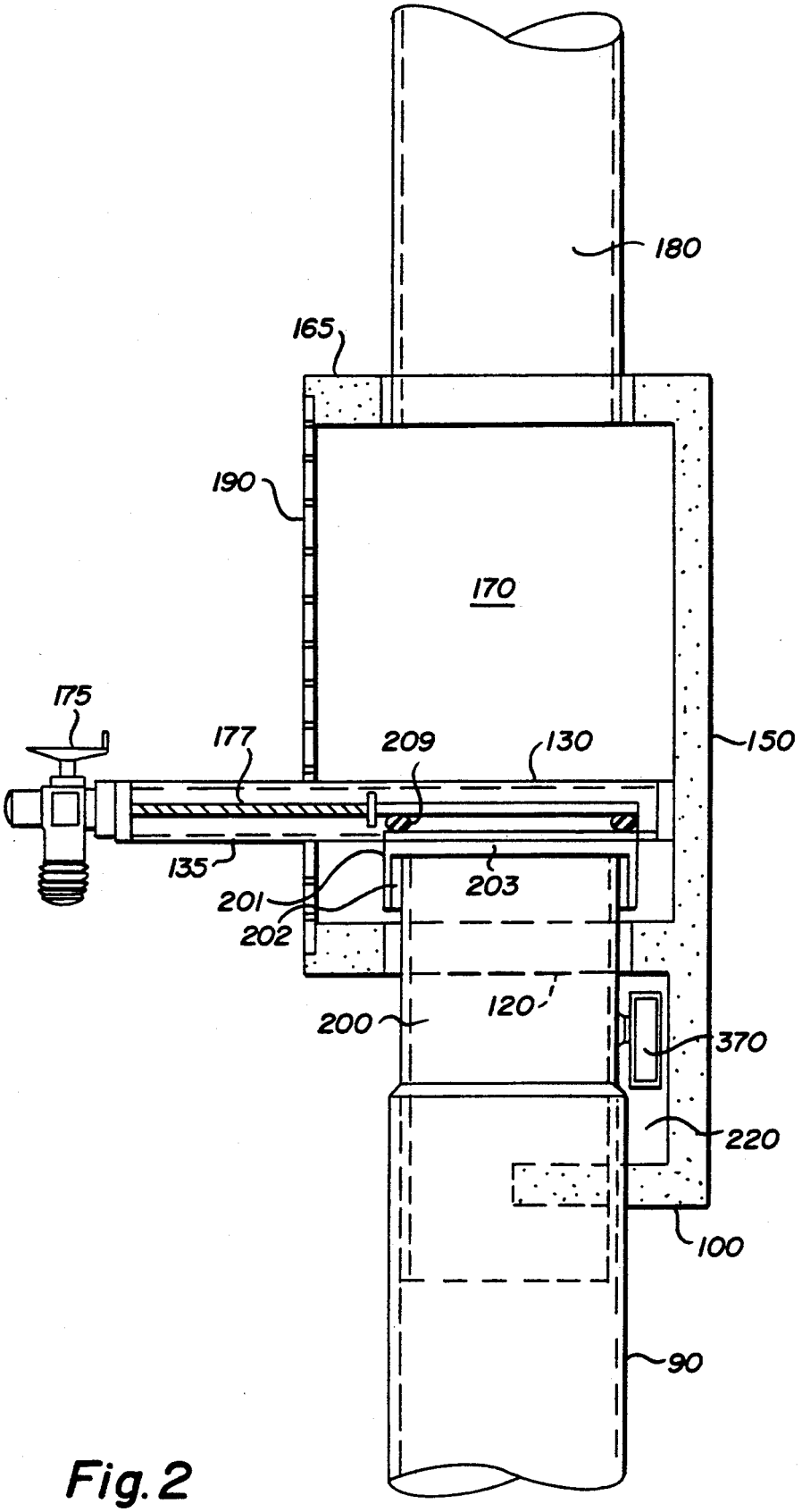
FIG. 2 is a side view of the catchment and canal gate structure.

Pipe support 100 is substantially U-shaped, and the bottom of pipe support 100 is curved approximately in the shape of a semi-circle to support the bottom of upstream section 90. The height of pipe support 100 is approximately the center of upstream section 90 as shown in FIG. 2.

Next, sensor chamber 370, containing e.g., a hydrocarbon sensor, is mounted in substantially the bottom of pipe brace 200. Hydrocarbon sensor chamber 370 mounts through the bottom of the upstream portion of the pipe brace 200 and connects with the upstream section 90 by a hole (not shown) creating a sensor area 220. As in FIG. 1, catchment 150 includes substantially rectangular support 120 which has a center hole which contains upstream section 90 of pipe. The approximate center of catchment 150 contains canal gate structure 130.

The canal gate structure 130 includes two substantially vertical columns 135 which are joined by cross member 137 at the top of vertical column 135 to guide canal gate 160 as the gate 160 is raised and lowered.

Proceeding downstream, access area 170 is a cavity in the catchment to allow personnel to enter the catchment and perform maintenance. Downstream support 165 provides support for downstream section 180 of pipe which allows flow of the uncontaminated water to the environment. The catchment 150 as shown in FIG. 1 is provided when the end of the pipe is not readily accessible. When the pipe end is readily accessible, the canal gate structure 130 is mounted on the end of upstream section 90. Lastly, access area 170 is covered by grate 190.

Preferably, canal gate structure 130 is located 24 inches from rectangular support 120. Canal gate structure 130 includes pipe brace 200 which is a substantially cylinder-shaped brace, flange 201 and a base 203. And upstream section 90 is mounted on flange 201 through pipe brace 200. As in FIG. 1, catchment 150 is covered by a grate 190 for preventing unauthorized personnel and large debris from entering the catchment. Grate 190 includes rectangular metal strips which are laid substantially perpendicular to other. Grate 190 is preferably located downstream of both sensor chamber 370 and gate 160 in order to prevent debris which has fallen into the catchment from fouling gate 160.

Rectangular support 120 divides catchment 150 into two areas, i.e., an access area 170 and a sensor area 220.

Motor 175, which raises and lowers gate 160, is mounted on the top of the cross member of canal gate structure 130. Motor 175 raises and lowers gate 160 via a drive stem 177. Drive stem 177 connects to gate 160 by gate clevis 267. Drive stem 177 and gate 160 are raised and lowered by motor 175.

Figure 3:
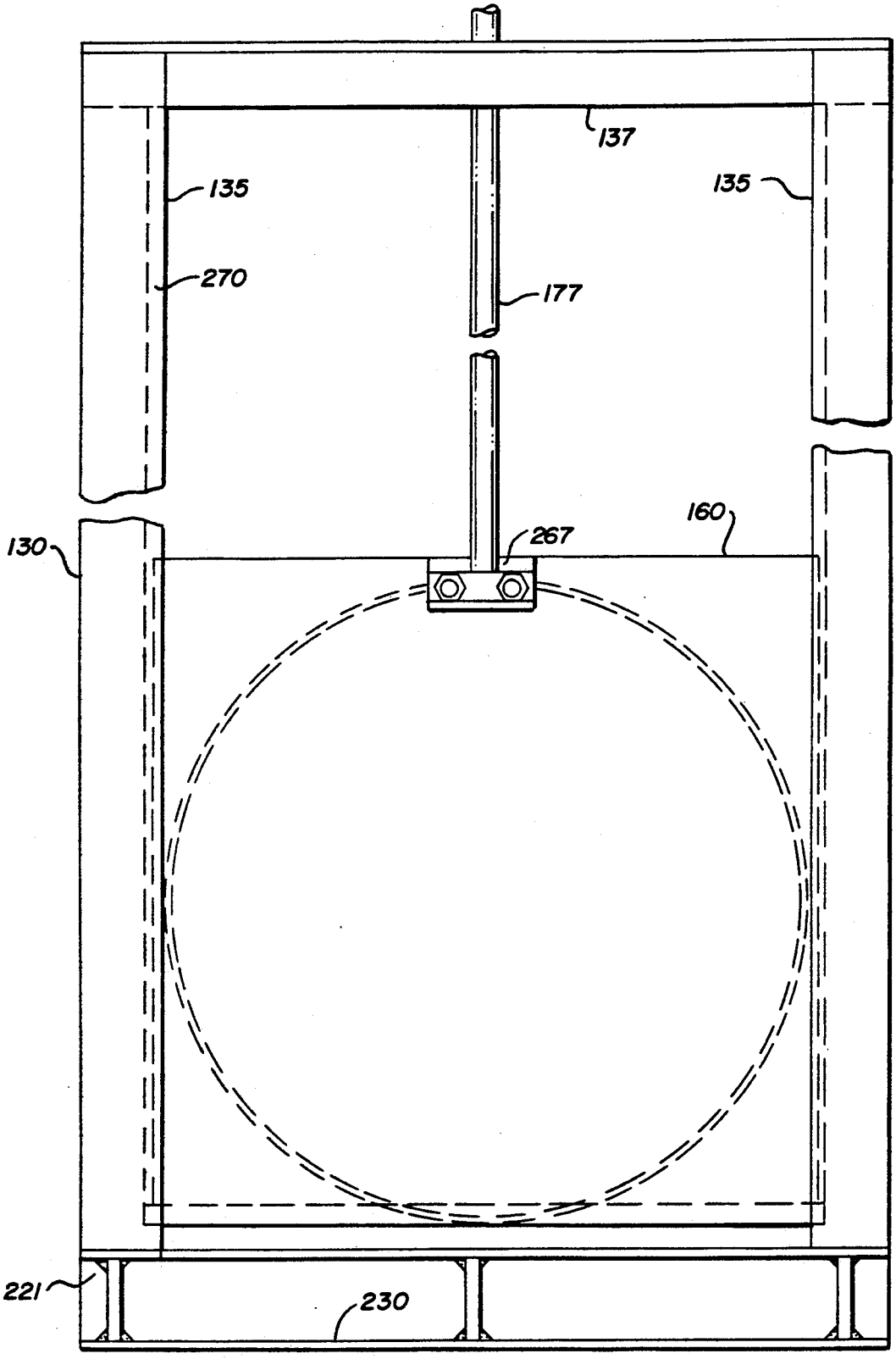
FIG. 3 is front view of the canal gate and the canal gate structure.
Figure 4:
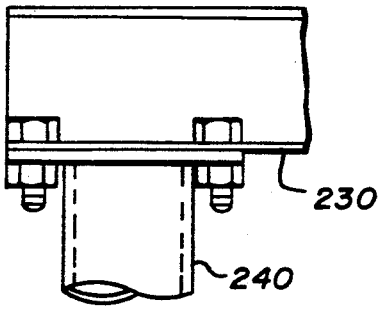
FIG. 4 is a front view of the lower platform and hollow pipe.

As shown in FIG. 3, gate structure 130 is mounted on a platform such as an I-beam platform 221 which is mounted on three hollow pipes 240 as shown in FIG. 4 which serve as pilings for the I-beam platform 221.

Canal gate structure 130 includes gate columns 135 which are substantially vertical columns having a track 270 which guides and raises and lowers gate 160. The distance from the center of the pipe to the top of gate column 135 is 63½ inches in the preferred embodiment. Tracks 270 are rectangular notches which are formed on the side of gate columns 135. Each gate column 135 includes one track 270 which opposes another track 270 in opposite gate column 135. Tracks 270 are formed from the top to the bottom of the columns, as shown in the drawings. Hollow pipe 240 serves as a piling for lower surface 230 of I-beam platform 221 and is filled with concrete. In the preferred embodiment, hollow pipes 240 are four inches in diameter. In the preferred embodiment, hollow pipe 240 includes mounting plate 245 which mounts to lower platform 230 by four bolts.

Figure 5:
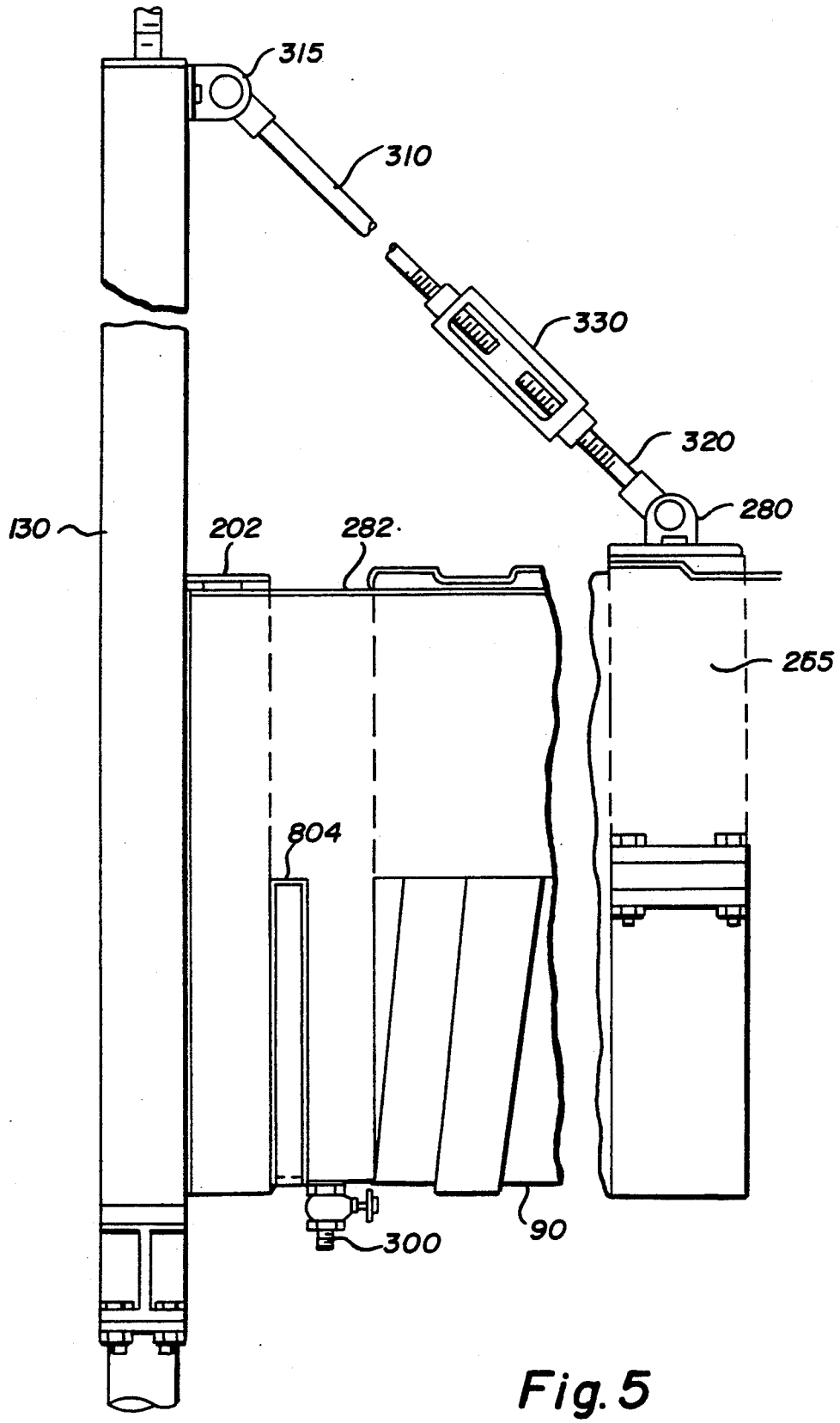
FIG. 5 is a side view of another embodiment of the canal gate structure.

When canal gate structure 130 mounts on the end of upstream section 90, the gate structure moves in the horizontal direction unless a support member is provided to arrest such horizontal movement. As shown in FIG. 5, another embodiment includes a gate structure 130 without a catchment. As also illustrated in FIG. 5 for use with another embodiment, clamp ring 265 is a circular ring which is joined in the area which corresponds to the middle of the pipe to form a base to support canal gate structure 130.

Figure 6:
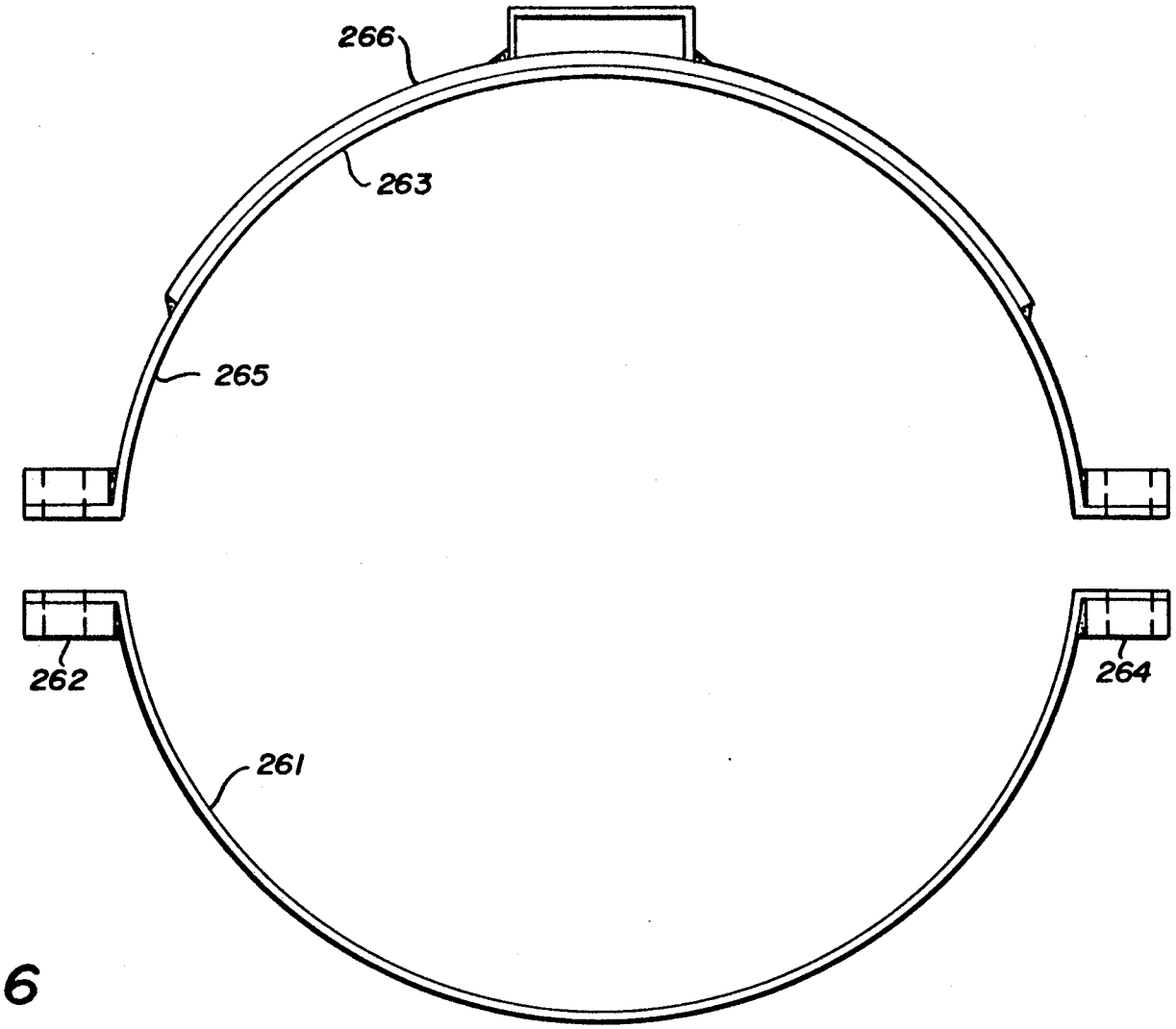
FIG. 6 is a front view of a clamp ring.

As shown in FIG. 6, clamp ring 265 includes two semi-circular ring-like members 261 and 263 which enclose upstream section 90 of pipe. Each of semi-circular ring-like members 261 and 263 includes connecting members 262 and 264 mounted at opposite ends of the flat area of the semi-circular ring-like members. The mounting members 263 each include two holes which allow bolts to join the ring-like members together. Two semi-circular ring-like members 261 and 263 have unequal radii which differ by an amount such as one half-inch. In the preferred embodiment, one semi-circular ring-like member 263 is 18 inches in diameter, and the second semi-circular ring-like member 261 is 18½ inches in diameter. Semi-circular ring-like member 263 includes reinforcing member 266 which is a base for lower clevis 280 and acts to provide additional reinforcement to clamp ring 265. Reinforced member 266 preferably mounts systemically on an axis which bisects the curved surface of semi-circular ring 263 and which is a radius of semi-circular ring-like member 263. The width of ring clamp 265 prevents canal gate structure 130 from movement. The two semi-circles of the clamp ring may be shimmed together.

Because canal gate structure 130 is a relatively high structure and only directly supported by the two vertical columns, additional support is desirable. Upper rod 310 and lower rod 320 provide this support. As shown in FIG. 5 canal gate structure 130 connects to upper clevis 315. Upper clevis 315 includes an axis to rotate upper rod 310. Likewise, lower clevis 280 is mounted on clamp ring 265 and includes an axis to rotate lower rod 320. Upper rod 310 connects to lower rod 320 through turnbuckle 330. The end of upper rod 310 and the end of lower rod 320 are threaded for connection with turnbuckle 330. Since ring clamp 265 may be mounted at any position on upstream section 90, the distance between ring clamp 265 and canal gate structure 130 will correspondingly vary. Upper rod 310 and lower rod 320 are fixed in length; the variation in distance is eliminated by turn buckle 330. Thus, turnbuckle 330 is rotated on upper rod 310 and lower rod 320 by the threaded connection until the correct distance is achieved.

To drain the system, an outlet is required. A threaded outlet (not shown) mounts on the bottom of spacer section 282. Globe valve 300 mounts on the threaded outlet and drains any liquid which accumulates in the drainage system and between spacer section 282 and canal gate structure 130.

Figure 7:
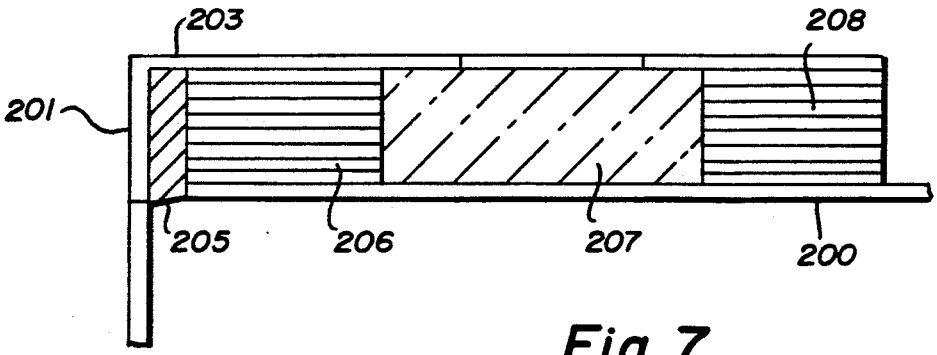
FIG. 7 is a side view of the seals.

Once hydrocarbons have been trapped in the culvert as a result of the closure of the gate, they must be prevented from leaking out. Gate 160 contains seals to prevent leakage of the hydrocarbons out into the environment from between gate 160 and canal gate structure 130 and between upstream section 90 and pipe brace 200. As shown in FIGS. 5 and 7, between pipe brace 200 and upstream section 90 a pipe seal 202 is provided. Pipe brace 200 is sealed with four separate seals which include two different types of seals. Located at the junction of base 203 and flange 201 is first rectangular seal 205 which preferably is a flexible joint sealer and which is approximately ¼ inch wide. Second seal 206 which is approximately 1 inch wide is constructed of 60 mil Goodyear Versigard roof membrane which is laminated and bonded. Third seal 207 which is the flexible joint sealer is adjacent to second seal 206, and fourth seal 208 is adjacent to the end of flange 203 and third seal 207.

Figure 9:
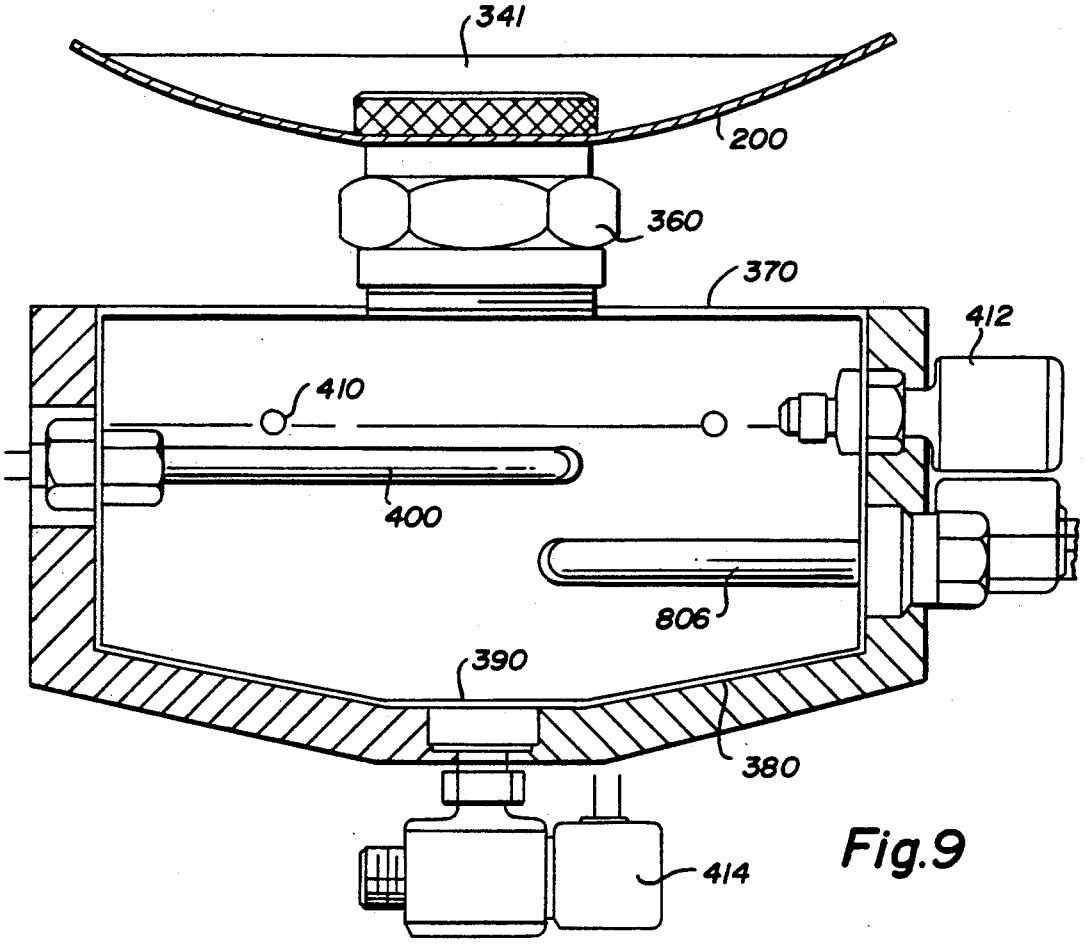
FIG. 9 is a side view of the sensor chamber.

As shown in FIG. 2, gate seal 209, preferably comprising neoprene, seals gate 160 with base 203 to prevent leakage at this point. Further, a leak of the liquid could occur if an operator or sensor 400 (see FIG. 9) attempted to lower gate 160 when ice had formed in the sensor area 220. Ice could prevent seals 209 from sealing upstream section 90, could damage gate 160 or prevent it from closing. The ice is prevented from forming by drum heater 804. In the preferred embodiment, drum heater 804 encloses approximately the bottom half of spacer section 282 (see FIG. 5) for about 120° of the circumference. The drum heater includes heater thermostat 803 to control the drum heater 804.

Figure 8:
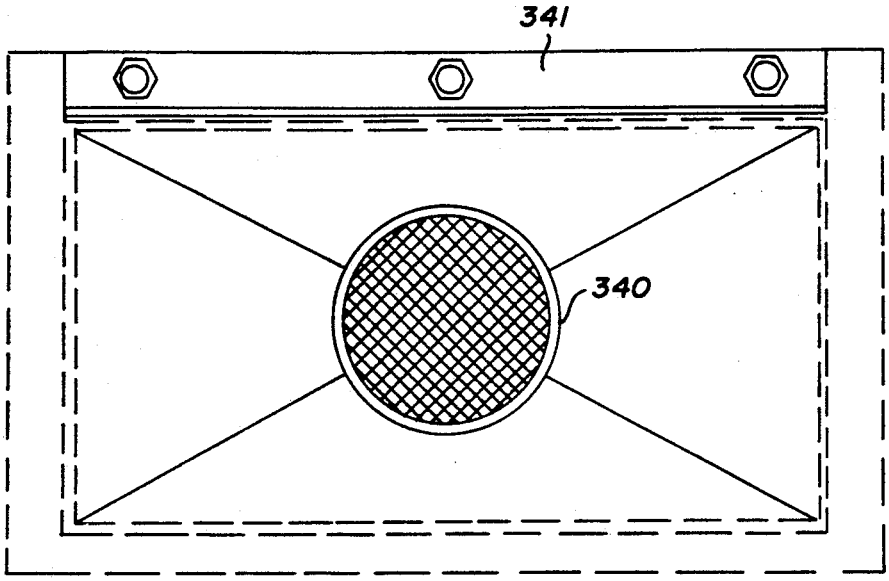
FIG. 8 is a top view of weir and screen.

Sensor 400 provides an indication that fuel such as hydrocarbon is present in the drainage system. In the bottom of pipe brace 200, weir 341, as shown in FIG. 8, is located to form a dam which prevents debris from entering screen 340 and which is approximately three inches high. The bottom of pipe brace 200 includes circular screen 340 to allow water, hydrocarbons and other contaminants to enter sensor chamber 370 but prevents debris which could foul sensor chamber 370 from entering.

Screen 340 is connected to sensor area 220 by threaded connector 360 which threads both into screen 340 and into sensor chamber 370 for allowing easy removal of sensor chamber 370 from screen 340. Sensor chamber 370 is substantially rectangular with a down sloping bottom. The bottom includes two downward sloping sections 380 which are connected to flat bottom 390. Hydrocarbon sensor 400, which is preferably an 8820 hydrocarbon sensor which is sold by Arjay Engineering Ltd., removably mounts in a side of sensor chamber 370.

Sensor chamber 370 includes a plurality of weep holes 410 which maintains water in the sensor chamber at a constant level. If water rises above the weep holes 410, the water is removed from sensor chamber 370 through weep holes 410. Weep holes 410 are located above hydrocarbon sensor 400 to ensure that sensor 400 is continuously below the water line. If sensor 400 is allowed to be exposed to air, a false alarm occurs. Sensor chamber 370 includes sensor heater 806 to assure that the liquid contained in sensor chamber 370 does not freeze. Sensor heater 806 (see FIG. 14) also is located under the liquid level. A-flush intake 412 is removably located on the sensor box side and includes a threaded intake for connection to the water supply which provides water to flush the sensor and screen. Sensor box 370 is insulated. B-flush drain 414, which is preferably located on the bottom on the flat portion 390, drains away water which flushes sensor box 370 and refills sensor box 370.

With a heavy rain, the drainage system could fill to capacity. Before the drain system overfills, the gate is reopened if it was closed earlier in response to a sensed fuel spill. The drainage system includes standpipe 430 which is a hollow pipe that extends to a vertical position which indicates that the drainage system is near an overload condition.

Figure 10:
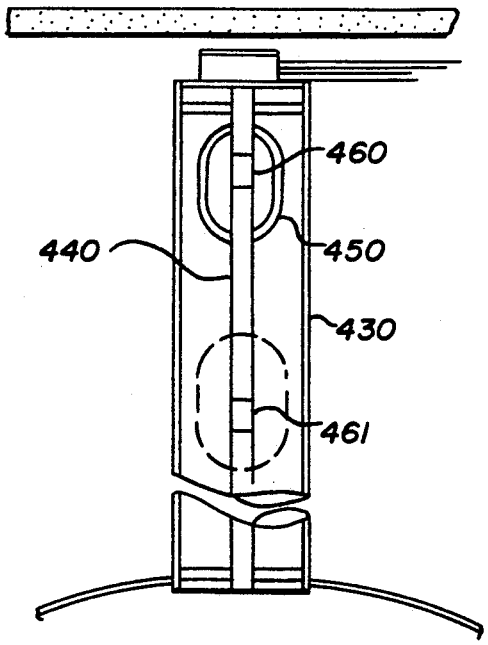
FIG. 10 is a side view of the overload float and level switches.
Figure 11:
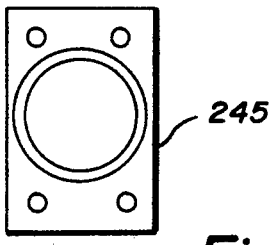
FIG. 11 is a top view of the mount for the I-beam.

As shown in FIG. 10, standpipe 430 is hollow and includes shaft 440 which is located in standpipe 430. Shaft 440 includes float 450 which freely rides shaft 440 and which indicates the overload condition in the drainage system. Located on shaft 440 is float 450, and, when the float 450 contacts float switch 460, float switch 460 provides an indication that the water in the drainage system has risen to the overfill condition. The closing of float switch 460 causes gate 160 to open. This allows the water and contaminants to flow into the environment but prevents the water and contaminants from backing up to the pavement area. In another embodiment, when a sensor senses that the water level has dropped to a safe level, the gate is activated. That is, a second liquid level detector 461 within shaft 440 senses a second liquid level at a level below that of float switch 460. Float 450 freely riding in shaft 440 contacts second liquid level detector 461 which sends a signal to the motor when the second liquid level is detected to enable the gate to occupy the closed position in response to the detection of a pollutant.

As an alternative embodiment, the closing of float switch 460 can cause valve 300 (see FIG. 5) to open to relieve the overfill condition, and when a sensor senses a safe water level, valve 300 is reclosed. The second sensor detects an amount of liquid at a level lower than that of the overflow condition and then provides a signal to the motor to close gate 160. In this embodiment, gate 160 can thus be maintained in a closed condition when pollutants are detected, with valve 300 is provided to alleviate overfill.

Figure 12:
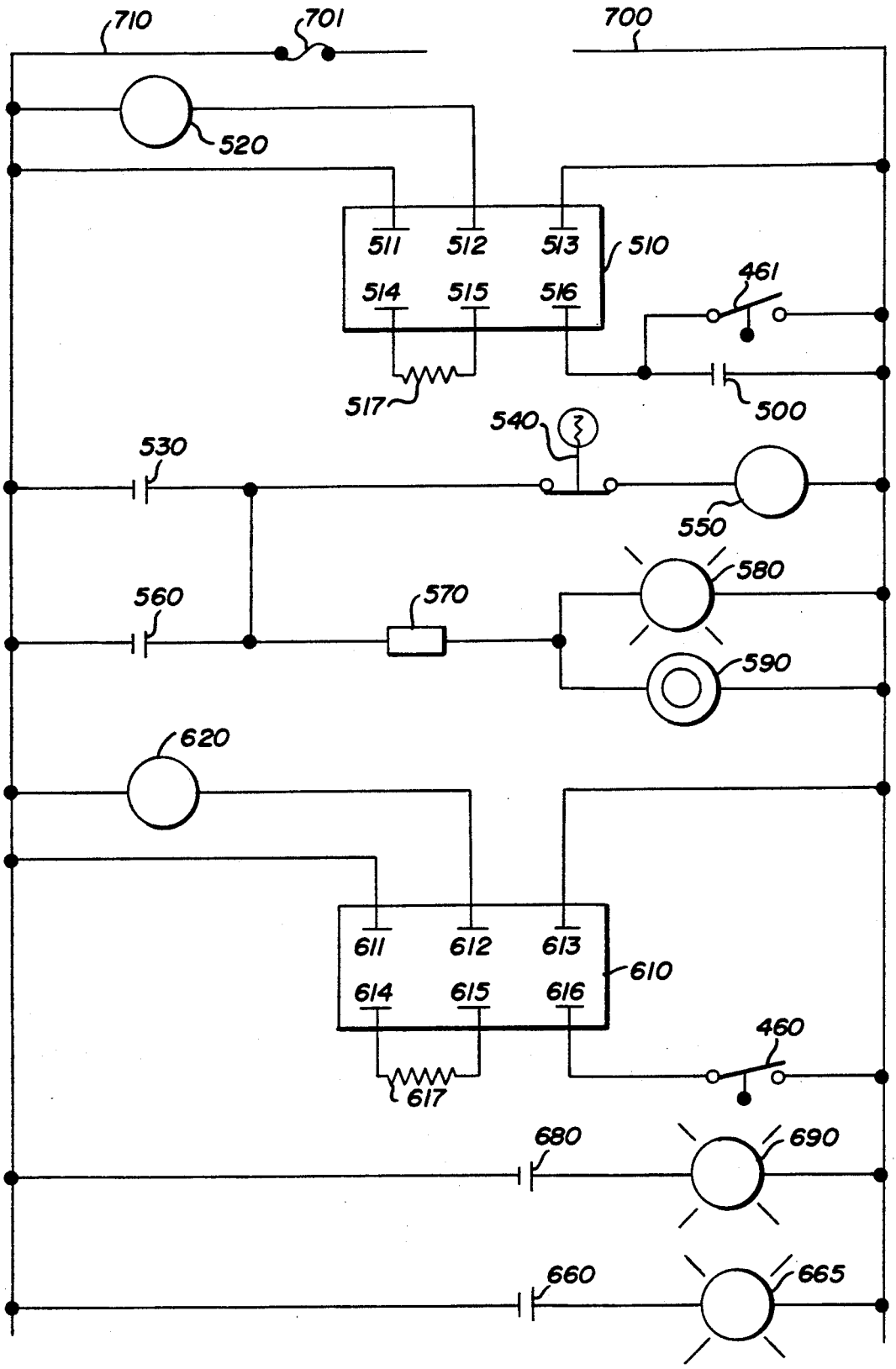
FIG. 12 is a circuit diagram of the one shots which activate the motor.

FIG. 12 illustrates an electrical circuit according to the invention. The purpose of the electrical system is to lower gate 160 responsive to electrical signals from a fuel sensor or manual means and to open gate 160 responsive to a sensed overfill condition in the drainage system, while allowing gate 160 to re-close responsive to float 450 when a safe water level condition is again detected.

A primary objective of the electrical system is to provide power to gate 160, yet this must be accomplished by a control signal which has a short duration. This short control signal is required to interrupt the closure of gate 160 to allow for the opening of gate 160. As shown in FIG. 12, between power bus 700 and power bus 710 is 120 volts A/C and power bus 710 is connected to fuse 701 to prevent electrical overloads. Sensor contact 500 of the hydrocarbon sensor is connected to power bus 700. Sensor contact 500 closes when hydrocarbon sensor 400 senses hydrocarbon being present in hydrocarbon sensor chamber 370. Hydrocarbon contact 500 activates one shot 510 at connection 516. One-shot connection 511 is connected to power bus 710, and one-shot connection 513 is connected to power bus 700. One-shot connection 514 is connected to timing resistor 517 which corresponds to a three second control signal. Timing resistor 517 is connected to one-shot connector 515.

Signals to activate the one-shot 510 from the hydrocarbon contact 500 can generally be of any duration. One-shot connection 512 is connected to first control relay 520. The three second control signal from one-shot 510 activates first control relay 520 which is connected to power bus 710. When the three second control signal is received from one-shot 510, first control relay 520 closes first control relay contact 530 for 3 seconds corresponding to the length of the three second signal. A relay can control a single contact, yet the relay may also control multiple contacts. These multiple contacts may be either normally opened or normally closed or a mixture of normally open or normally closed. First control relay 520 and fourth control relay 550 are such relays. First control relay 520 controls two contacts which are both normally open. Fourth control relay 550 controls three contacts. Two contacts are normally open, and one contact is normally closed. First control relay contact 530 of first control relay 520 is connected to reset keylock 540 to prevent the alarms from operating unless the operator has turned the key to the appropriate position.

When the gate 160 is lowered either manually or in response to sensor 400, sensor 400 and heaters 804 and 806 have their power removed. The power is restored by reset keylock 540 by an operator. Reset keylock 540 connects to fourth control relay 550. When reset keylock 540 is closed and first control relay contact 530 of first control relay 520 is closed, power flows through fourth control relay 550. Fourth control relay 550 closes fourth control relay contact 560 of fourth control relay 550 which is connected to power bus 710 and which connects to first control relay contact 530. Since fourth control relay 550 is activated, and since fourth control relay contact 560 is closed, the circuit path between fourth control relay 550 and fourth control relay contact 560 is closed for the three seconds corresponding to the three second control signal. The three second control signal ends; first control relay 520 is deactivated; and first control relay contact 530 is opened. However, after the control signal has ended, fourth control relay 550 remains activated and fourth control relay contact 560 remains closed. This operation allows gate 160 to be subsequently closed while being reopened if required. When either first control relay contact 530 or fourth control relay contact 560 are closed, amber light 580, sona-alert 590 and flasher 570 operate to provide warning of the closing gate. This warning continues until the reset keylock 540 breaks the connection of fourth control relay 550. Fourth control relay contact 560 opens, and fourth contact 801 which is a second contact of fourth control relay 550 returns to the normally closed position reestablishing power to the sensor 400 and heaters 804 and 806. As shown in FIG. 15, when fourth control relay 550 is conducting, fourth control relay contact 601 which is a third contact of fourth control relay 550 closes which connects to an energy power supply 603 and is connected to telephone dialer 602 to alert plant personnel at a remote location.

As shown in FIG. 12, float switch 460 is connected to power bus 700 and to one-shot connection 616 to open gate 160. One-shot connection 611 is connected to power bus 710 and one-shot connection 613 connects to power bus 700. One-shot connection 614 is connected to timing resistor 617 to provide a three second control signal, and timing resistor 617 connects to one-shot connector 615. Timing resistor 617 corresponds to the length of time that the control signal is supplied to one-shot connection 612. Fifth control relay 620 activates fifth control relay contact 630 as illustrated in FIGS. 13 and 17 to open gate 160. Additionally, reset keylock 640 is directly connected to motor 175 to manually activate the opening of gate 160. As shown in FIG. 13, manual switch 505 and first contact 530 which is a second contact of first control relay 520 are connected to motor 175 to close gate 160. As shown in FIG. 20, second control relay 670 is activated, when motor 175 closes gate 160, and second control relay contact 680 closes to connect to power bus 710. Second control relay contact 680 is connected to red indication light 690 which is connected to power bus 700. Third control relay 650 is activated when gate 160 is opened. As illustrated in FIG. 19, third control relay 650 when activated closes third control relay contact 660 which is connected to power bus 710 and green indicator 665. Green indicator 665 is connected to power bus 700 and provides an indication of open gate 160.

FIG. 14 shows the circuit which controls the flush and fill circuits and the heaters. The power to the flush and fill devices and the heaters is controlled by fourth contact 801 which is a normally closed relay contact and which is connected to power bus 710. Fourth contact 801 connects to timer 810 and to both thermostats 803 and 805. Fourth contact 801 is controlled by fourth control relay 550 which is activated as described above.

FIGS. 14 and 18 show a timer 810 which determines a time period 900 which in a preferred embodiment is twelve hours and controls timer contact 820 which is open during the twelve hour period. However, at the end of the twelve hour period, timer contact 820 is closed to activate the flush and fill circuitry. Timer contact 820, when closed, activates dummy load 821 which in a preferred embodiment is a five kilohm five watt resistor.

Timer contact 820 additionally activates flush/fill timer 830 which alternately activates A-flush intake 412 and B-flush drain 414. A-intake 412 connects to the water supply to flush sensor chamber 370 and screen 340. B-flush drain 414 drains away the water which flushes sensor chamber 370, and A-intake 412 refills sensor chamber 370 maintaining the water level. Flush-/fill timer 830 includes relay 831. Relay 831 connects to power bus 700 and operates A-contact 840 and B-contact 800. Timer contact 820 connects to A-contact 840 and to B-contact 800. A-contact 840 is normally closed and connects to A-flush intake 412 which connects to power bus 700. Flush timer 830 allows contact 840 to remain closed for time period 910 which is approximately 30 seconds. At the end of 30 seconds, A-contact 840 is open, and B-contact 800 is closed. B-contact 800 activates B-flush drain 414 which connects to power bus 700. Flush timer 830 closes contact 800 during time period 920 which has an approximately 120 second duration. During time period 920, B-flush drain 414 drains sensor box 370. At the end of time period three 920, B-flush fill 412 fills sensor chamber 370 permitting the operation of sensor 400. Sensor 400 connects to power bus 700 and to sixth control relay contact 850. The power to sensor 400 is disconnected as the flush/fill operation is proceeding. The sensor 400 disconnects from the power by sixth control relay 855. As time contact 820 is closed, sixth control relay 855 is activated. Sixth control relay 855 opens sixth control relay contact 850 which is a normally closed contact. The drum heater thermostat 803 connects to contact 801 and drum heater 804 is connected to drum heater thermostat 803 and to power bus 700. Sampling chamber thermostat 805 connects to contact 801, and sampling chamber heater 806 connects to sampling chamber thermostat 805 and power bus 700. When the gate is activated by a hydrocarbon fourth control relay 550 is energized opening contact 801. This kills all power in the sensor chamber area and heater 804 to prevent fire. The specific timing of A-flush intake 412 and B-flush drain 414 can be varied depending on the expected fouling conditions in the sensor box 370.

As illustrated in FIGS. 13 and 16, switch 930 connects to motor 175 to stop the gate.

It should be noted that the above description and the accompanying drawings are merely illustrative of the application of the principles of the present invention and are not limiting. Numerous other arrangements which embody the principles of the invention and which fall within its spirit and scope may be readily devised by those skilled in the art.

What is claimed is:

1. A storm drainage system, comprising:

at least one conduit means for guiding liquid;

a gate disposed on said conduit means, said gate in an open position allowing said liquid to pass by said gate within said conduit means and in a closed position blocking passage of said liquid within said conduit means; and means for remotely activating said gate to occupy said closed position in response to an operator's detection of the presence of a pollutant within said conduit means.

2. A storm drainage system comprising:

at least one conduit means for guiding liquid;

a gate disposed on said conduit means, said gate in an open position allowing said liquid to pass by said gate within said conduit means and in a closed position blocking passage of said liquid within said conduit means;

a motor means for controlling said gate to alternately occupy said open and said closed position; and a sensor means positioned to detect the presence of a pollutant within said conduit means and for activating said motor to close said gate in response to a detection of said pollutant within said conduit means.

3. The storm drainage system as in claim 2, further comprising liquid level sensing means for detecting the presence of a first predetermined amount of liquid within said storm drainage system and for providing a high-liquid-level override signal to said motor means in response to detection of said first predetermined amount of liquid within said storm drainage system to open said gate independently of said detection of said pollutant within said conduit means by said sensor means.

4. The storm drainage system as in claim 3, wherein said liquid level detection means further comprises means for detecting the presence of a second predetermined amount of liquid lower than said first predetermined amount of liquid within said storm drainage system after said liquid level detection means has detected said first predetermined amount of liquid within said storm drainage system and for providing a signal to said motor means when said second predetermined amount of liquid is detected to enable said gate to occupy said closed position again responsive to a detection of said pollutant within said conduit means.

5. A canal gate system as in claim 1, wherein said remote activation means includes a manual switch connected to said gate to close said gate manually when an operator detects that a pollution spill has occurred.

6. A system as in claim 2, wherein said motor means is a reversible motor such that said motor means can be reversed in a direction to open said gate before said gate is completely closed.

7. A system as in claim 2, wherein said motor means includes a drive stem for connecting said motor means with said gate, and for raising and lowering said gate.

8. A system as in claim 2, wherein said sensor means is a hydrocarbon sensor which detects the presence of hydrocarbons.

9. A system as in claim 2, further comprising a drain pipe connected to said conduit means for emptying said drainage system, said sensor means being located in the bottom of said drain pipe.

10. A system as in claim 9, further comprising a sensor chamber housing, said sensor means and means for continuously filling said sensor chamber with liquid to prevent said sensor means from providing a false alarm.

11. A system as in claim 10, wherein said sensor chamber includes a heater to prevent said liquid from freezing.

12. A system as in claim 10, wherein said sensor chamber includes a flush means for cleaning said sensor means.

13. A system as in claim 12, wherein said flush means includes a timer means to activate and deactivate said flush means in accordance with a timed flush cycle.

14. A system as in claim 2, further comprising a brace means for supporting said canal gate to prevent said canal gate from moving in a horizontal direction.

15. A system as in claim 2, further comprising a drain pipe connected to said conduit means for emptying into the environment, said gate being mounted at a position upstream of the end of the pipe.

16. A system as in claim 2, wherein said motor means is mounted on said gate.

17. A system as in claim 2, further comprising a platform disposed in said conduit means for mounting said gate.

18. A system as in claim 1, further comprising an overload means for detecting an overload condition of said drainage system and for causing said gate to occupy said open position independently of whether said remote activation means is attempting to cause said gate to be in said closed position.

19. A system as in claim 18, wherein said overload means includes a float to indicate said overload of said drainage system.

20. The system as in claim 2, further comprising a valve means mounted on said conduit means, and a liquid level sensing means for detecting the presence of a first predetermined amount of liquid within said storm drainage system and for providing a high-liquid-level override signal to said motor means in response to detection of said first predetermined amount of liquid within said storm drainage system to open said valve means independently of said detection of said pollutant within said conduit means by said sensor means.

21. The storm drainage system as in claim 20, wherein said liquid level detection means further comprises means for detecting the presence of a second predetermined amount of liquid lower than said first predetermined amount of liquid within said storm drainage system after said liquid level detection means has detected said first predetermined amount of liquid within said storm drainage system and for providing a signal to said motor means when said second predetermined amount of liquid is detected to close said valve means.

22. A storm drainage system as in claim 2, further comprising a sensor chamber for housing the sensor means, said sensor chamber including heating means for preventing ice from forming in said sensor chamber.

* * * * *

UNITED STATES PATENT AND TRADEMARK OFFICE

CERTIFICATE OF CORRECTION

PATENT NO. : 5.067,850

DATED : November 26, 1991

INVENTOR(S) : Robert L. Gray

It is certified that error appears in the above-identified patent and that said Letters Patent is hereby corrected as shown below:

Column 10, Claim 1, line 1, delete "storm".

10, Claim 2, line 1, delete "storm"

Column 11, Claim 3, line 1, delete "storm"

line 4, delete "storm"

line 6, delete "storm"

Claim 4, line 1, delete "storm"

line 5, delete "storm"

line 7, delete "storm"

Column 11, Claim 10, line 2, delete ",".

Column 12, Claim 20, line 4, delete "storm"

line 7, delete "storm".

Claim 21, line 1, delete "storm".

line 5, delete "storm".

line 7, delete "storm".

Claim 22, line 1, delete "storm".

line 2, second instance, change "chamber" to --housing--.

Signed and Sealed this

Ninth Day of March, 1993

*Attest:*

STEPHEN G. KUNIN

*Attesting Officer*

*Acting Commissioner of Patents and Trademarks*